US009249615B2

(12) United States Patent
Arteta Loredo

(10) Patent No.: US 9,249,615 B2
(45) Date of Patent: Feb. 2, 2016

(54) PIVOTING SHUTTER HAVING ADJUSTABLE SLATS FOR BUILDINGS

(71) Applicant: Agustin Arteta Loredo, Cabrils (ES)

(72) Inventor: Agustin Arteta Loredo, Cabrils (ES)

( * ) Notice: Subject to any disclaimer, the term of this patent is extended or adjusted under 35 U.S.C. 154(b) by 0 days.

(21) Appl. No.: 14/384,284

(22) PCT Filed: Feb. 21, 2013

(86) PCT No.: PCT/ES2013/000041
§ 371 (c)(1),
(2) Date: Sep. 10, 2014

(87) PCT Pub. No.: WO2013/140003
PCT Pub. Date: Sep. 26, 2013

(65) Prior Publication Data

US 2015/0052815 A1 Feb. 26, 2015

(30) Foreign Application Priority Data

Mar. 20, 2012 (ES) ..... 201230411

(51) Int. Cl.

| | |
|---|---|
| ***E06B 7/09*** | (2006.01) |
| ***E04F 10/10*** | (2006.01) |
| ***E06B 9/06*** | (2006.01) |
| ***E06B 7/086*** | (2006.01) |
| ***E06B 7/096*** | (2006.01) |

(52) U.S. Cl.
CPC . *E06B 7/09* (2013.01); *E04F 10/10* (2013.01); *E06B 7/086* (2013.01); *E06B 7/096* (2013.01); *E06B 9/0638* (2013.01); *E06B 9/0669* (2013.01)

(58) Field of Classification Search
USPC ..... 160/62, 207, 213, 115, 61; 49/77.1
IPC ..... E06B 7/09; E04F 10/10; E05D 15/564, E05D 15/266
See application file for complete search history.

(56) References Cited

U.S. PATENT DOCUMENTS 2,337,785 A * 12/1943 Thurman ..... 160/60
2,570,018 A * 10/1951 Williamson ..... 160/62

(Continued)

FOREIGN PATENT DOCUMENTS

CN 102121339 A 7/2011
ES 2157735 A1 8/2001

(Continued)

OTHER PUBLICATIONS

International Search Report for corresponding International Application No. PCT/ES2013/000041.

*Primary Examiner* — David Purol
(74) *Attorney, Agent, or Firm* — Egbert Law Offices, PLLC

(57) ABSTRACT

A pivoting shutter having adjustable slats for buildings includes an upper panel provided with a first group of adjustable slats, mounted by the upper end thereof on a horizontal pivoting shaft. A lower panel is provided with a second group of adjustable slats, hinged by the upper end thereof to the upper panel and connected by the lower end thereof to a driving means for vertical movement for pivoting the panels between an open position and a closed position. First and second connectors are provided, which, when rotating the slats, link the adjustable slats of the first and second groups, respectively. A transmission mechanism links the two groups of slats in the closed position of the upper and lower panels, enabling in the closed position the simultaneous rotation of all the slats, and maintaining the groups of slats unlinked from one another in the open position of the panels.

6 Claims, 8 Drawing Sheets

(56) References Cited

U.S. PATENT DOCUMENTS

| | | | | |
|---|---|---|---|---|
| 2,611,936 | A * | 9/1952 | Wheeler | 160/54 |
| 2,631,341 | A * | 3/1953 | Pettigrew et al. | 49/74.1 |
| 3,120,035 | A * | 2/1964 | Morris | 49/77.1 |
| 5,402,840 | A | 4/1995 | Jortner et al. | |
| 2011/0219692 | A1 | 9/2011 | Ohanesian | |

FOREIGN PATENT DOCUMENTS

| | | | |
|---|---|---|---|
| JP | 2005290896 | A | 10/2005 |
| JP | 2011137315 | A | 7/2011 |

* cited by examiner

PIVOTING SHUTTER HAVING ADJUSTABLE SLATS FOR BUILDINGS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a pivoting shutter having adjustable slats for buildings, comprising at least: two fixed uprights, and a panel carrying a group of slats mounted on respective rotary shafts and linked by a connector which connects them in the rotation; said panel being movable between an open position and a closed position.

This invention is applicable to the manufacture of exterior shutters for buildings.

2. Description of Related Art Including Information Disclosed Under 37 CFR 1.97 and 37 CFR 1.98

Currently, there are in the market different shutters having adjustable slats having generally a perimetral frame, or at least two fixed uprights, and a panel carrying a group of slats mounted on respective rotary shafts and linked by a connector which connects them in the rotation.

A typical example of this type of shutters is blinds formed by two sheets or panels with adjustable slats. Said panels, depending on the type of shutter, can move in different ways: in the case of sliding shutters the panels move laterally in parallel planes, and in the case of blinds the sheets or panels are mounted on the fixed frame by means of lateral hinges, which allow its lateral rotation between the open and closed positions.

These shutters have several functional disadvantages: a first drawback is determined by the interference of the slats of panels in certain positions with the adjacent panels or walls during the movement of the sheets or panels towards the open position; these interferences can determine damage to the slats and limit the movement of said panels.

Another drawback of these shutters having adjustable slats is that in the closed position of the panels, the passage of light and vision through the shutter can be adjusted by varying the orientation of the adjustable slats, however, in the open position, the sheets or panels, both sliding shutter and blinds, are placed outside the gap of the shutter and do not provide it any protection.

Another of the drawbacks of mentioned shutters, especially in those cases where there are areas accessible from the outside, either by being in a ground floor or in a terrace, is that the handles or knobs for opening and closing panels are visible from the outside, through the gaps defined between the consecutive slats, especially when these have a certain width. This makes it possible that the shutter can be opened from the outside, providing a low protection against intrusion and theft.

BRIEF SUMMARY OF THE INVENTION

The pivoting shutter having adjustable slats for buildings, object of this invention, comprises at least two fixed uprights and a panel carrying a group of adjustable slats mounted on respective rotary shafts and linked by a connector which connects them in the rotation; and said panel being movable between an open position and a closed position. Said pivoting shutter having adjustable slats for buildings has constructive particularities aimed to solve the outlined problems.

One of the objects of the invention is to avoid possible interference and damage to the slats during the opening and closing of the shutter.

Another of the objects of the invention is to achieve that the shutter provides, in the open position, a protection for the gap of the building in which is installed, but leaving it completely free; that is, enabling the vision and even the passage through the entire gap.

Another of the objects of the invention is to prevent the manipulation and unwanted opening of the shutter from the outside of the same, providing a high protection against intrusion and theft.

For this purpose, and in accordance with the invention, this shutter comprises:

an upper panel provided with a first group of adjustable slats and mounted by the upper end thereof on a horizontal pivoting shaft, a lower panel provided with a second group of adjustable slats, hinged by the upper end thereof to the upper panel and connected by the lower end thereof to driving means for vertical movement for pivoting the upper and lower panels between an open position, in which said panels form with each other an angle less than 180°, and a closed position in which said panels are vertically aligned, covering the gap between said uprights;

a first and second connectors which link respectively the adjustable slats of the first group and of the second group, connecting in the rotation the slats belonging to a same group, and a transmission mechanism which links the two groups of slats in the closed position of the panels, enabling in said closed position the simultaneous rotation of all the slats of the upper panel and of the lower panel; and maintaining the groups of slats unlinked of the upper and lower panels, when said panels are in an open position.

The aforementioned basic or essential characteristics of the shutter, collected in the first claim, determine that, in the open position, the upper and lower panels provided with the corresponding groups of adjustable slats define with each other an angle less than 180°, protruding from the front side of the top of the gap of the building in which are installed; the shutter forming in this position a cantilever surface forming means of protection against the sun, rain and atmospheric agents in general; however keeping the mentioned gap completely open and without interfering with the vision or passage trough the same.

According to the invention, it is envisioned that only one of the groups of slats is connected to motorized driving means; the transmission mechanism being responsible for allowing the simultaneous driving of the groups of slats located in the upper and lower panels when the upper and lower panels are in the closed position, i.e., aligned vertically. In this way, the orientation of all the slats can be carried out simultaneously, with motorized driving means linked to a single group of slats, when the shutter is in the closed position, since in the total or partial open position such transmission mechanism unlinks the groups of slats of the upper and lower panels.

It is worth mentioning that the driving means for vertical movement, responsible for causing the pivoting of the upper and lower panels and consequently carrying out the opening or closing of the shutter, may be of a different nature and incorporate weight compensating elements such as counterweights linked to the lower end of the lower panel by means of cables suitably guided in pulleys, to facilitate the opening and closing of the shutter by the driving means for vertical movement.

According to the invention, the transmission mechanism which links the two groups of slats in the closed position of the panels comprises at least two main wheels rotating mutually with the slats of the upper panel and of the lower panel respectively, said main wheels being arranged in areas close to the facing ends of the upper and lower panels. This mechanism further comprises an intermediate wheel connecting in the rotation the two main wheels when the upper and lower panels are aligned in the closed position.

Both the main wheels and the intermediate wheel may be gear wheels or wheels provided with an exterior coating consisting of a material with a high friction coefficient, for example rubber working by friction in this case.

In an embodiment of the invention, the intermediate wheel is mounted on one of the upper or lower panels, permanently coupled with the main wheel corresponding to the group of slats of said panel, said intermediate wheel protruding from the hinged end of the mentioned panel to contact with the main wheel of the other panel when the shutter reaches the closed position.

BRIEF DESCRIPTION OF THE DRAWINGS

In order to complement the description that is being carried out and with the object to help to a better understanding of the invention, a set of drawings is accompanied to the present specification in which, with an illustrative and non-limiting character, the following has been represented.

DETAILED DESCRIPTION OF THE INVENTION

Figure 1:
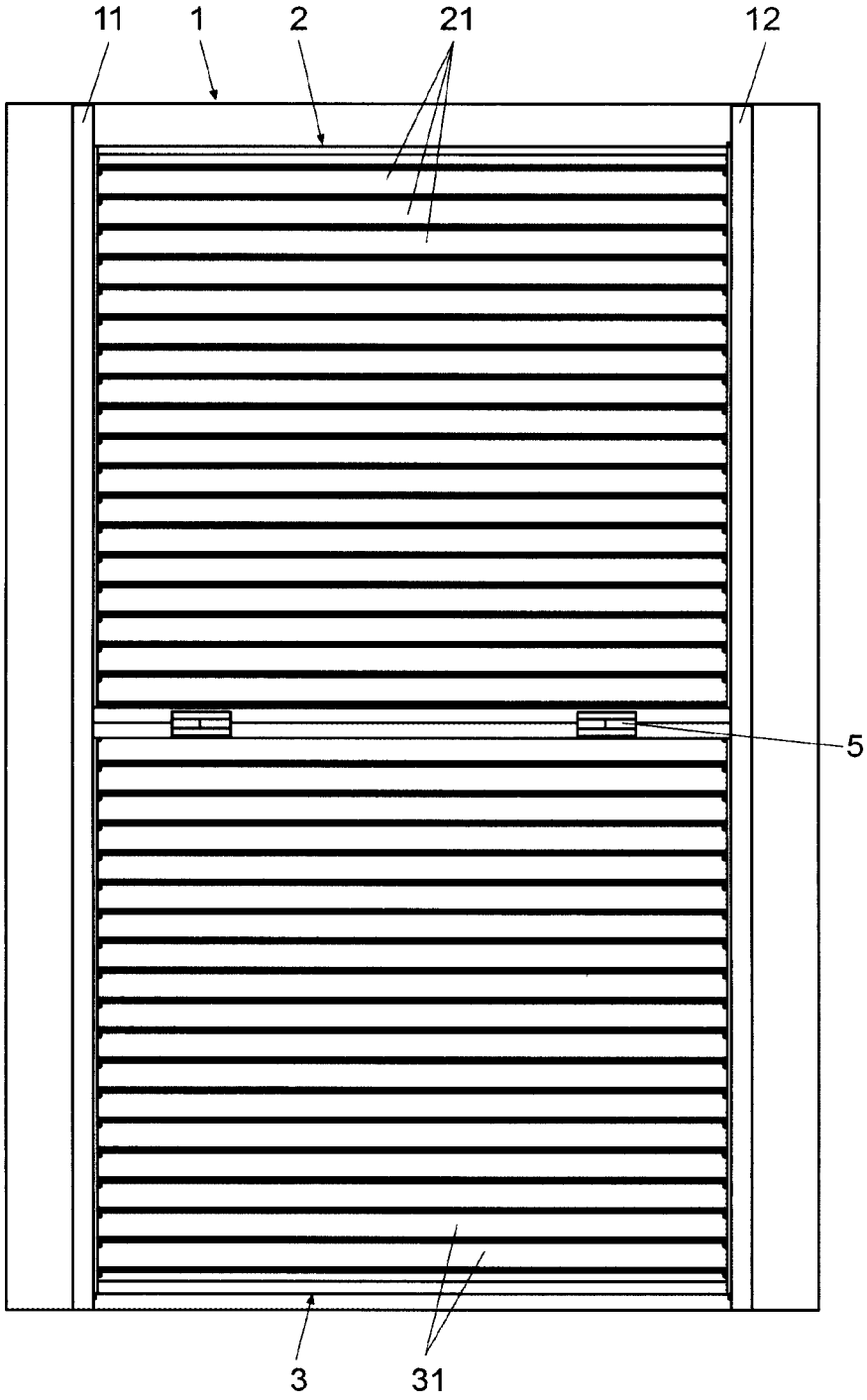
FIG. 1 shows a rear elevation view of an example embodiment of the shutter of the invention in closed position.

As can be seen in the example embodiment shown in the attached figures, this pivoting shutter having adjustable slats for buildings comprises two uprights (11, 12), which in this case are part of a fixed perimetral frame (1) on which an upper panel (2) carrying a first group of adjustable slats (21), and a second lower panel (3) provided with a second group of adjustable slats (31) are mounted.

The upper panel (2) is mounted by the upper end thereof on a horizontal pivoting shaft (4), being linked to each other the upper and lower panels (2, 3) by the facing ends by hinges (5).

Figure 2:
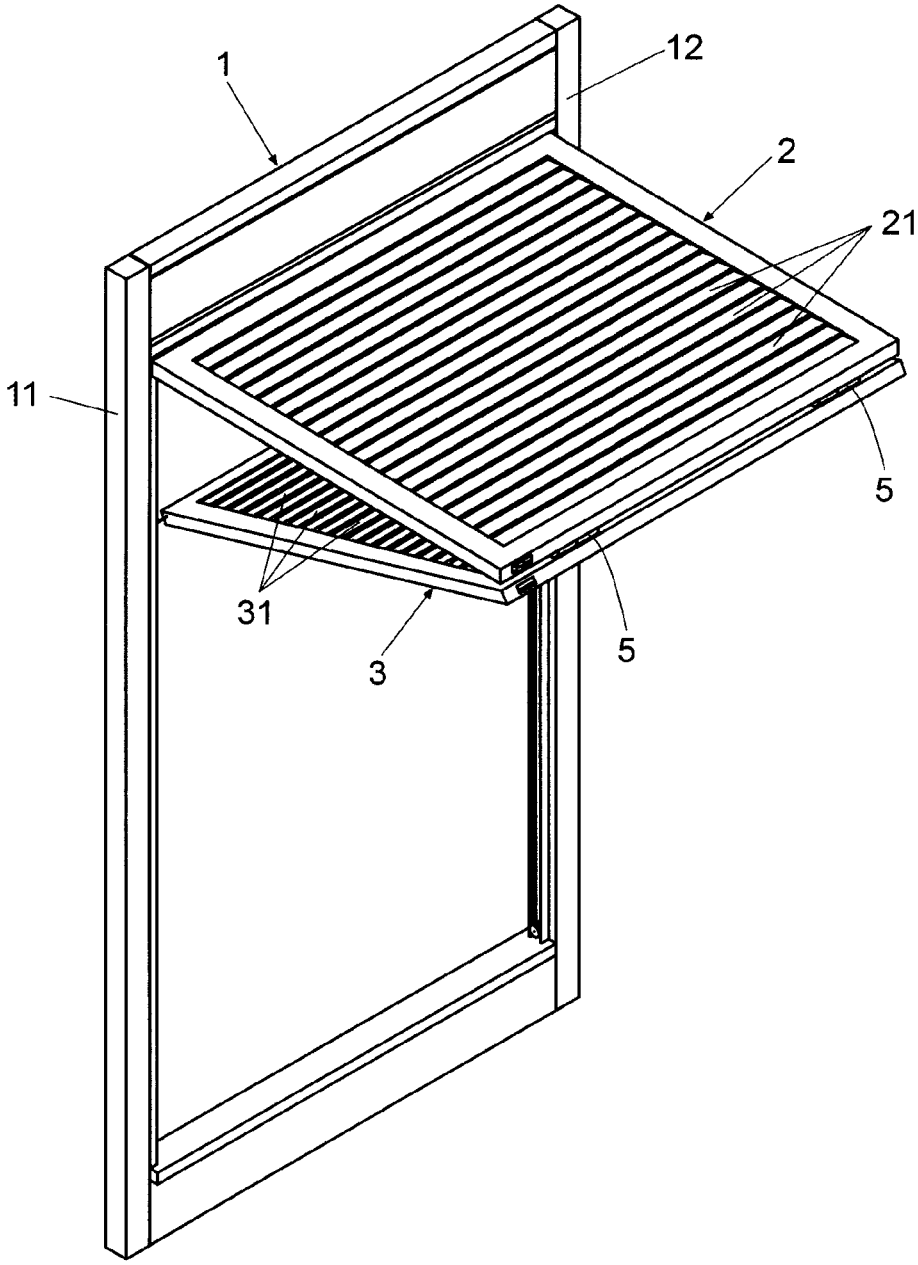
FIG. 2 shows a front perspective view of the shutter in open position.

The lower panel (3) is in turn linked by the lower end thereof with driving means (6) for vertical movement, when driven, cause the pivoting of said upper and lower panels between an open position in which said panels form with each other an angle less than 180°, as can be seen for example in FIG. 2, and a closed position in which said panels are vertically aligned as seen in FIG. 1.

Figure 5:
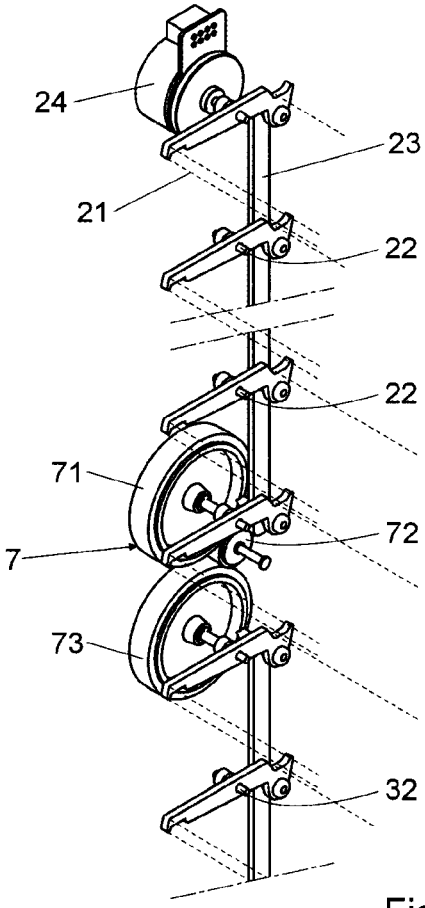
FIG. 5 shows a perspective partial view of connectors which link respectively the slats of the group corresponding to the upper panel and of the group corresponding to the lower panel as well as of the transmission mechanism and motorized driving means coupled in this case to the group of slats of the upper panel.

The adjustable slats (21) of the first group are mounted, with possibility of rotation, on the upper panel by respective horizontal shafts (22) and are linked to each other by means of a first connector (23) which connects them in the rotation, in such a way that all the slats (21) will change simultaneously their direction when rotating by the action of motorized driving means (24) which are depicted in FIG. 5 by a motor element that acts on the shaft (22) of one of the slats of the group corresponding to the upper panel (2).

The adjustable slats (31) corresponding to the group of the lower panel (3) are also mounted with the possibility of rotation about respective horizontal shafts (32) and are linked to each other by a second connector (33) that connects them in the rotation.

Figure 3:
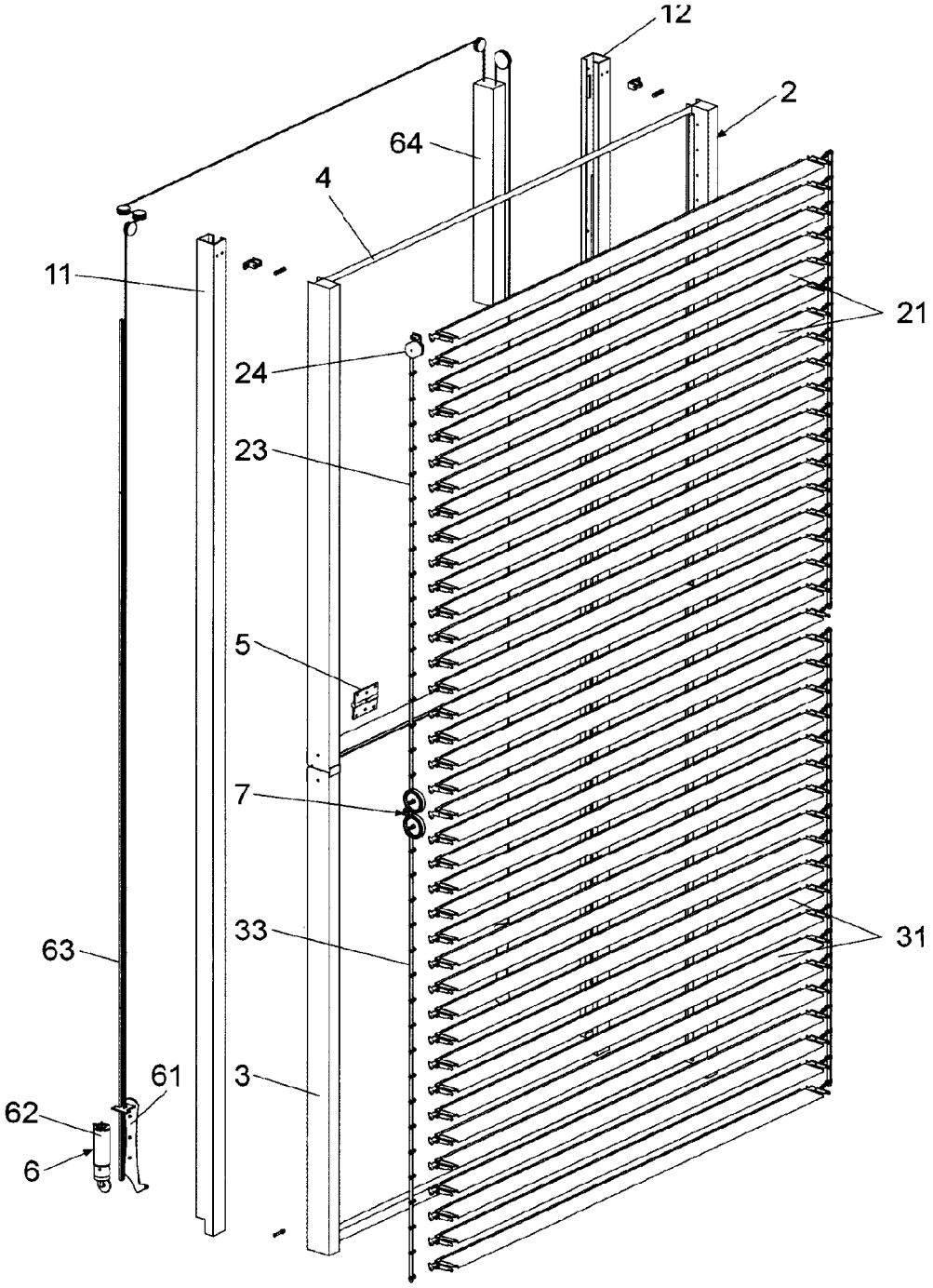
FIG. 3 shows a perspective exploded view of the shutter of the previous figures.
Figure 4:
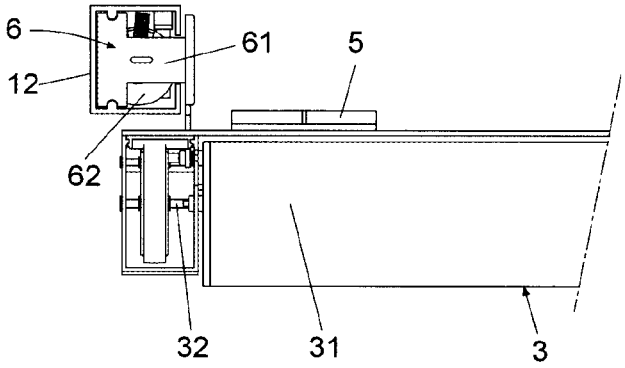
FIG. 4 shows a plan detail of the coupling of lower panel to the driving means for vertical movement housed in one of the fixed uprights.

In the example embodiment shown in FIGS. 3 and 4, the driving means (6) responsible for causing the lifting or lowering of the lower end of the lower panel (3) to carry out the opening and closing of the shutter consist in this case of a support (61) that moves vertically inside of one of the uprights (11), fixed by the action of a motor (62) which, when driven in either direction, moves together with the support (61) along a toothed bar (63).

The aforementioned toothed bar (63) may be either a rack or spindle, depending on the available means of the motor (62) for the gearing with the aforementioned toothed bar (63).

As can be seen in FIG. 3, the aforementioned support (61) may be linked to a counterweight (64) responsible for partially compensating the weight of the upper and lower panels (2, 3) to facilitate both the opening and closing of the shutter.

Figure 6:
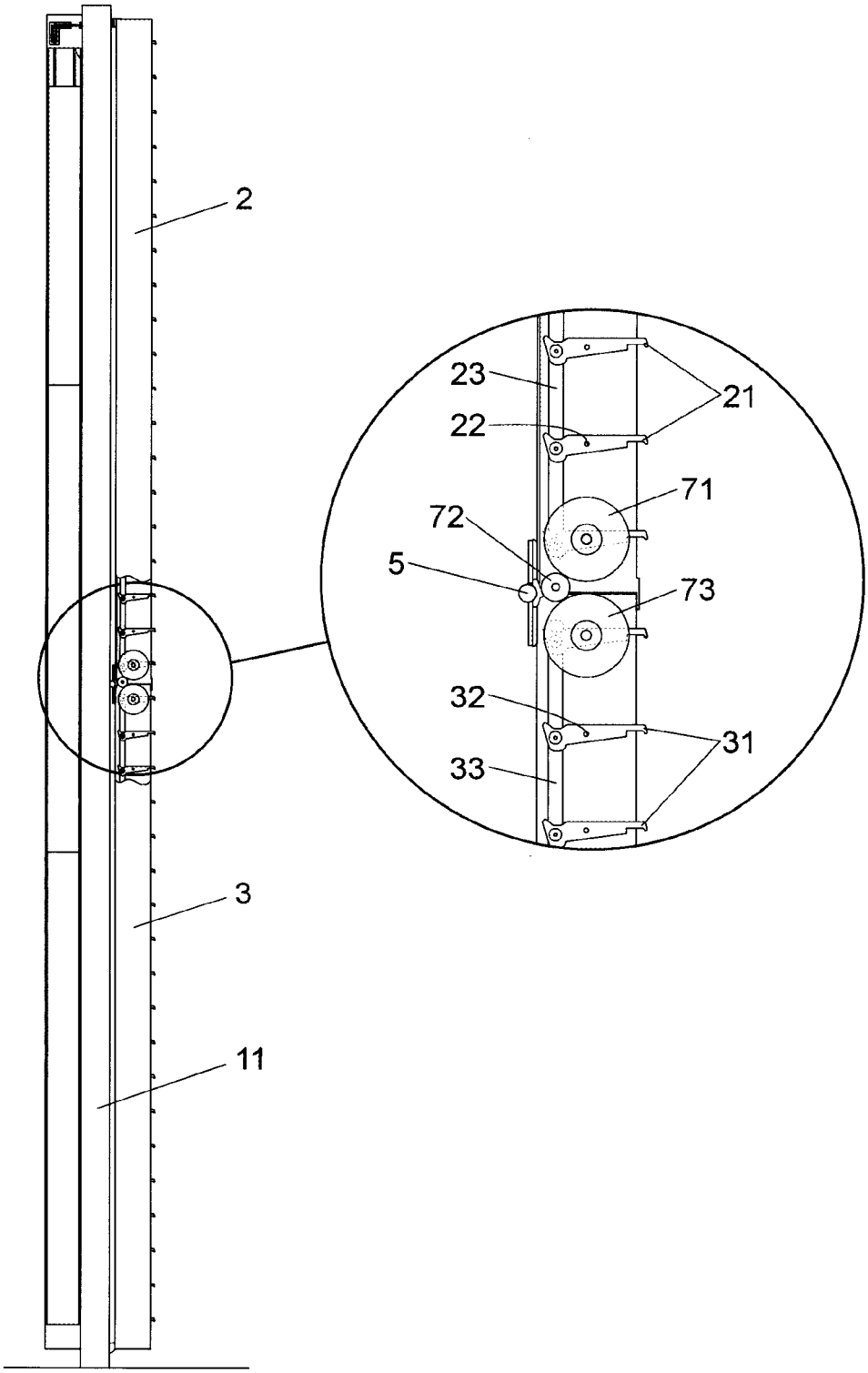
FIG. 6 shows a profile view of the shutter partially cross-sectioned and an enlarged detail of the transmission mechanism which links the two groups of slats, in operating position.
Figure 7:
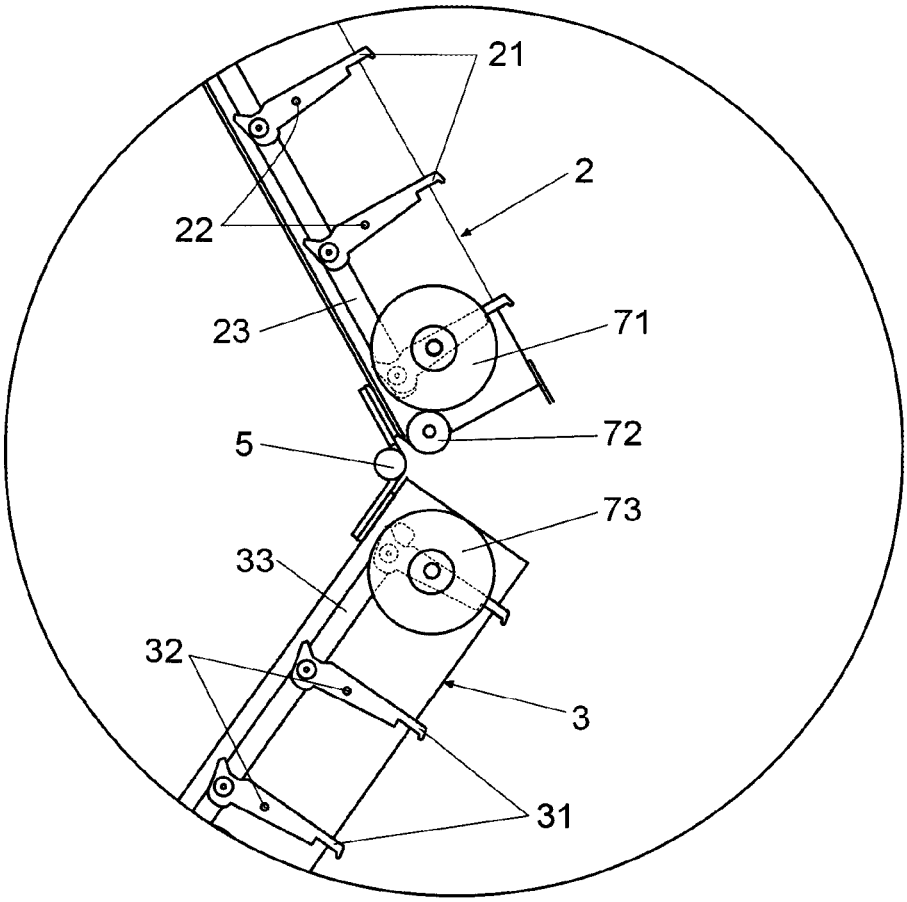
FIG. 7 shows a detail of the transmission mechanism of previous figure in inoperative position determined by the opening of the upper and lower panels and in which maintains the groups of slats unlinked of said upper and lower panels.

As can be seen in FIGS. 5, 6 and 7, the shutter has a transmission mechanism (7) enabling the driving of all the slats (21 and 31) by the motorized driving means (24), linked to the group of slats (21) of the upper panel, when the shutter is in the closed position, i.e. with the upper and lower panels (2, 3) being aligned vertically.

Such transmission mechanism (7) comprises a main wheel (71) rotating mutually with the slats (21) of the upper panel, an intermediate wheel (72) maintained permanently in contact with the main wheel (71) rotating together with that, and a second main wheel (73) rotating at the same time with the slats (31) of the group corresponding to the lower panel (3).

The main wheels (71, 72) are arranged in an area close to the facing ends of the upper (3) and lower panels (4), the intermediate wheel (32) being responsible for connecting in rotation to the two main wheels (71, 73) only when the upper and lower panels are aligned in the closed position as shown in FIGS. 5 and 6.

When the upper (2) and lower panels (3) move to an open position as shown in FIG. 7, the intermediate wheel (72) loses contact with the main wheel (73) linked to the slats (31) of the group corresponding to the lower panel (3).

Figure 8:
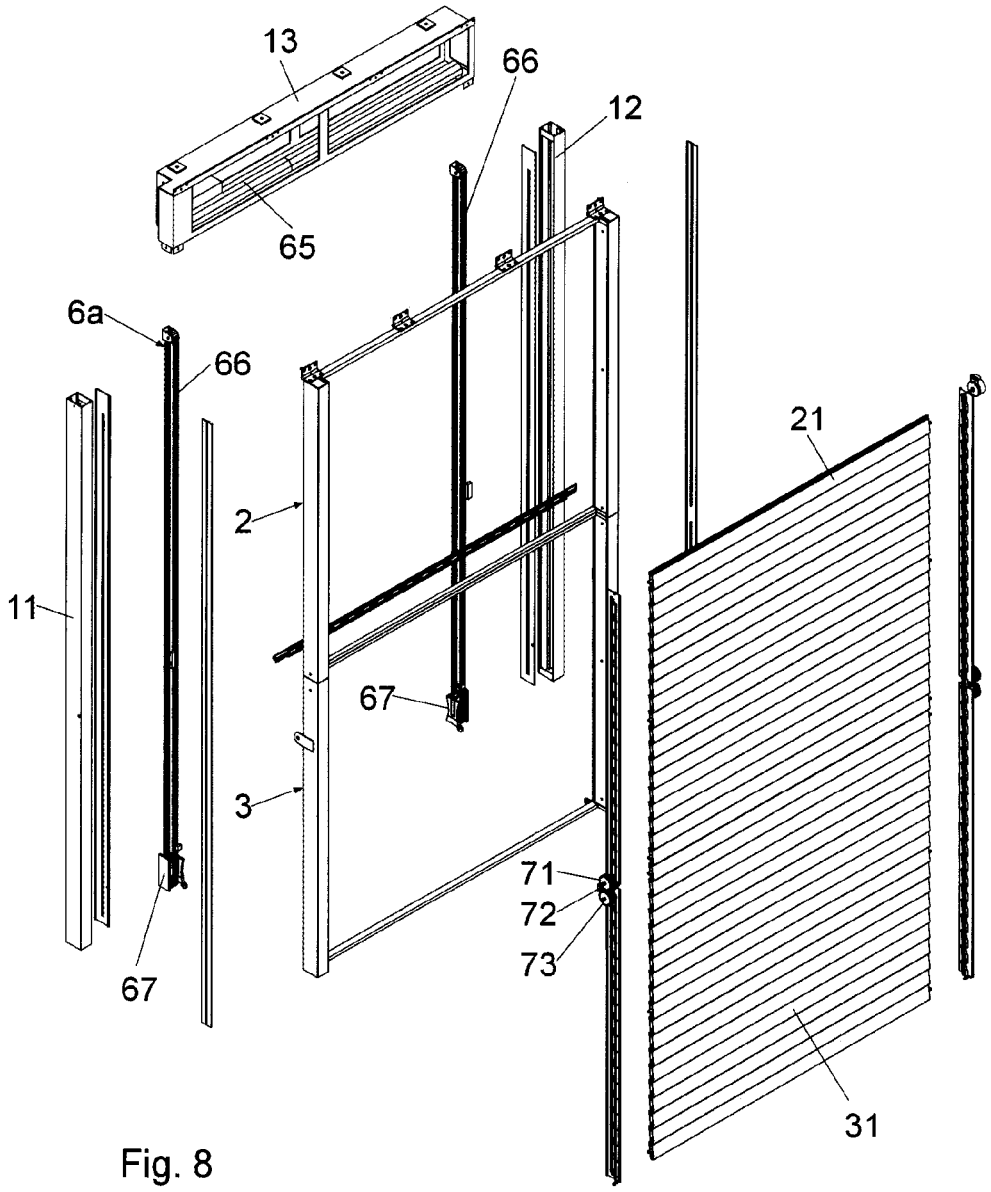
FIG. 8 shows a perspective exploded view of a variant of embodiment of the pivoting shutter having adjustable slats, according to the invention, in which the driving means responsible for causing the opening and closing of the shutter comprise a motor housed in an upper upright of a fixed perimetral frame and drives a toothed belt drive.
Figure 9:
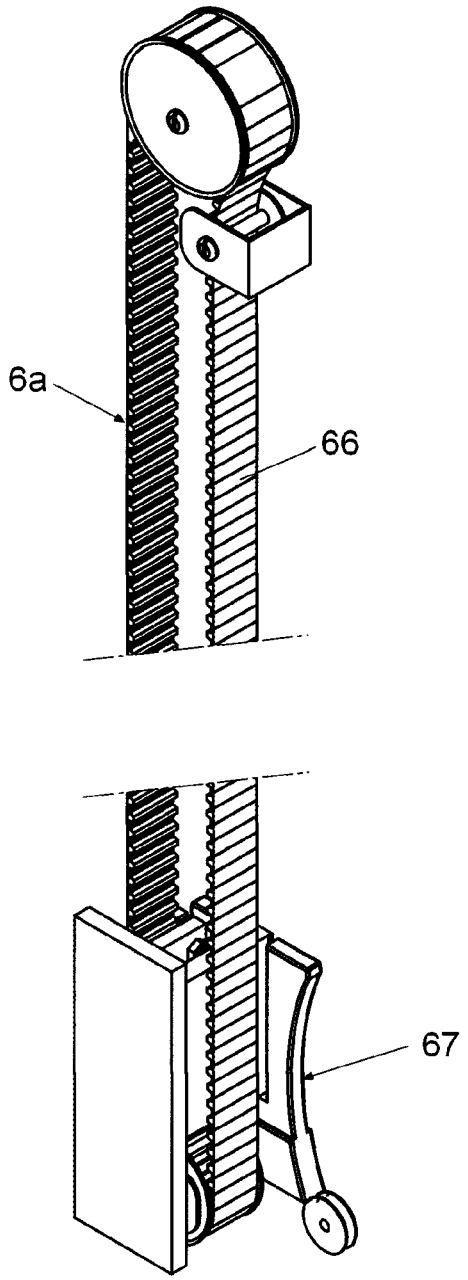
FIG. 9 shows an enlarged detail of a toothed belt drive of the previous figure.

In the variant of embodiment shown in FIG. 8, the shutter has for its opening or closing driving means (6*a*) comprising a motor (65) housed in an upper upright (13) of the fixed perimetral frame of the shutter, and drives directly toothed belts (66) carrying both pulling parts (67) coupled to the lower end of the lower panel (3).

The driving of the toothed belts (66), in either direction, by the motor (65) causes the vertical movement of the pulling parts (67) in the up or down direction, and consequently the pivoting of the upper and lower panels (2, 3) towards the open position or the closed position.

Having sufficiently described the nature of the invention as well as a preferred example embodiment thereof, it is stated for all intents and purposes that the materials, shape, size and arrangement of the elements described may be modified provided this does not entail altering the essential features of the invention which are claimed below.

The invention claimed is:

1. A pivoting shutter having adjustable slats for buildings comprising at least: two fixed uprights, and a panel carrying a group of adjustable slats mounted on respective rotary shafts and linked by a connector which connects them in the rotation; said panel being movable between an open position and a closed position; characterized in that it comprises:

an upper panel provided with a first group of adjustable slats, mounted by the upper end thereof on a horizontal pivoting shaft;

a lower panel provided with a second group of adjustable slats, hinged by the upper end thereof to the upper panel and connected by the lower end thereof to driving means for vertical movement for pivoting the upper and lower panels between an open position, in which said panels form with each other an angle less than 180°, and a closed position in which said panels are vertically aligned, covering the space between said uprights;

at least a first connector and a second connector which, when rotating the slats, link the adjustable slats of the first group, and the adjustable slats of the second group respectively; and, a transmission mechanism which links the two groups of slats in the closed position of the upper and lower panels, enabling in said closed position the simultaneous rotation of all the slats of the upper panel and the lower panel; and maintaining the groups of slats of the upper and lower panels unlinked when said panels are in an open position.

2. The pivoting shutter having adjustable slats for buildings, according to claim 1, characterized in that one of the groups of slats, is connected to motorized driving means.

3. The pivoting shutter having adjustable slats for buildings, according to claim 1, characterized in that the transmission mechanism which links the two groups of slats in the closed position of the upper and lower panels, comprises at least two main wheels, rotating mutually with the slats, of the upper panel and lower panel respectively, and arranged in areas close to the facing ends of the upper and lower panels, and an intermediate wheel connecting in the rotation the two main wheels when the upper and lower panels, are aligned in the closed position.

4. The pivoting shutter having adjustable slats for buildings, according to claim 3, characterized in that the intermediate wheel is mounted on one of the upper and lower panels, and permanently coupled with the main wheel, corresponding to the group of slats, of said panel; protruding from the hinged end of said upper or lower panel, in order to contact with the main wheel, of the other lower or upper panel when the shutter reaches the closed position.

5. The pivoting shutter having adjustable slats for buildings, according to claim 1, characterized in that the driving means, responsible for causing the lifting or lowering of the lower end of the lower panel to carry out the opening or closing of the shutter, comprises a support that moves vertically inside of one of the uprights, fixed by the action of a motor which, when driven in either direction, moves together with the support along a toothed bar.

6. The pivoting shutter having adjustable slats for buildings, according to claim 1, characterized in that the driving means comprising a motor housed in an upper upright of the fixed perimetral frame of the shutter, and drives directly toothed belts carrying both pulling parts coupled to the lower end of the lower panel.

* * * * *